US009649841B2

(12) United States Patent
Yamaguchi

(10) Patent No.: US 9,649,841 B2
(45) Date of Patent: May 16, 2017

(54) INKJET HEAD AND INKJET RECORDING DEVICE

(71) Applicant: Konica Minolta, Inc., Chiyoda-ku, Tokyo (JP)

(72) Inventor: Hironobu Yamaguchi, Tachikawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/115,003

(22) PCT Filed: Jan. 26, 2015

(86) PCT No.: PCT/JP2015/051981

§ 371 (c)(1),
(2) Date: Jul. 28, 2016

(87) PCT Pub. No.: WO2015/115353

PCT Pub. Date: Aug. 6, 2015

(65) Prior Publication Data

US 2016/0347055 A1 Dec. 1, 2016

(30) Foreign Application Priority Data

Jan. 31, 2014 (JP) ..... 2014-016804

(51) Int. Cl.
*B41J 2/175* (2006.01)
*B41J 2/14* (2006.01)
(Continued)

(52) U.S. Cl.
CPC ..... *B41J 2/04563* (2013.01); *B41J 2/1433* (2013.01); *B41J 2/14072* (2013.01);
(Continued)

(58) Field of Classification Search
CPC .. B41J 2/04563; B41J 2/17593; B41J 2/1433; B41J 2/14201; B41J 2/14072;
(Continued)

(56) References Cited

U.S. PATENT DOCUMENTS 5,605,659 A * 2/1997 Moynihan ..... B41J 2/14201 347/71

FOREIGN PATENT DOCUMENTS

JP H081928 A 1/1996
JP 2003170586 A 6/2003
(Continued)

OTHER PUBLICATIONS

International Search Report corresponding to Application No. PCT/JP2015/051981; Date of Mailing: Apr. 21, 2015, with English translation.

*Primary Examiner* — Julian Huffman
(74) *Attorney, Agent, or Firm* — Cantor Colburn LLP

(57) ABSTRACT

Provided are an inkjet head and an inkjet recording device that can effectively heat an ink near nozzles of a nozzle board or an ink inside a head chip. The inkjet head includes the head chip in which a nozzle board, an intermediate plate, a pressure chamber board, a spacer board, and a wiring board are joined in order, a common ink chamber forming member provided at a side of the wiring board of the head chip to form at least a part of a common ink chamber, and a heater provided to the common ink chamber forming member. The nozzle board is smaller than the intermediate plate when the head chip is viewed from the side of the nozzle board in plan view. A thermal conductive member being in contact with the heater and joined with the nozzle board and the wiring board across the head chip is provided. At least a part of the wiring board and a part of the common ink chamber forming member are joined through the thermal conductive member. The thermal conductive member is joined with a side surface of the nozzle board and a nozzle board-side surface of the intermediate plate, the nozzle board-side surface being larger than the nozzle board.

16 Claims, 6 Drawing Sheets

(51) Int. Cl.

| | |
|---|---|
| ***B41J 2/16*** | (2006.01) |
| ***B41J 2/195*** | (2006.01) |
| ***B41J 2/045*** | (2006.01) |
| ***B41J 2/155*** | (2006.01) |

(52) U.S. Cl.
CPC ..... *B41J 2/14201* (2013.01); *B41J 2/14233* (2013.01); *B41J 2/155* (2013.01); *B41J 2/161* (2013.01); *B41J 2/1623* (2013.01); *B41J 2/17593* (2013.01); *B41J 2/195* (2013.01); *B41J 2202/19* (2013.01)

(58) Field of Classification Search
CPC ..... B41J 2/155; B41J 2/14233; B41J 2/161; B41J 2/1623; B41J 2/195; B41J 2202/19
See application file for complete search history.

(56) References Cited

FOREIGN PATENT DOCUMENTS

| | | | |
|---|---|---|---|
| JP | 2007090694 | A | 4/2007 |
| JP | 2009051153 | A | 3/2009 |
| JP | 2010023257 | A | 2/2010 |
| JP | 2010194767 | A | 9/2010 |
| JP | 2012071440 | A | 4/2012 |

* cited by examiner

INKJET HEAD AND INKJET RECORDING DEVICE

CROSS REFERENCE TO RELATED APPLICATIONS

This is the U.S. national stage of application No. PCT/JP2015/051981 filed on Jan. 26, 2015. Priority under 35 U.S.C. §119(a) and 35 U.S.C. §365(b) is claimed from Japanese Application No. 2014-016804, filed Jan. 31, 2014, the disclosure of which is also incorporated herein by reference.

TECHNICAL FIELD

The present invention relates to an inkjet head and an inkjet recording device.

BACKGROUND ART

Conventionally, there is an inkjet recording device that changes a solid ink or a gel ink into a liquid ink by heat, and discharges the liquid ink toward a recording medium through a plurality of nozzle openings, thereby to form an image. In the inkjet recording device, characteristics of the ink depend on the temperature. Therefore, it is necessary to appropriately manage the temperature of ink passages in the inkjet recording device for prevention of clogging and maintenance of an optimum condition such as maintenance of uniform quality.

For example, Patent Literature 1 discloses a technology to provide ink supply paths to nozzles in a bottom surface closely to both side surfaces of an inkjet head, and provide heaters in contact with outer surfaces of the both side surfaces and arrange thermal conductive plates being in contact with the heaters on the both side surfaces, thereby to uniformly hold the temperature of the ink flowing in the ink supply paths on the both sides and the nozzles.

CITATION LIST

Patent Literature

Patent Literature 1: JP 2010-194767 A

SUMMARY OF INVENTION

Technical Problem

In recent years, however, head chips are highly accurately and efficiently manufactured in an array manner by stacking a plurality of layers in parallel to form a layered structure using the micro electro mechanical systems (MEMS) technology. In an inkjet head formed by such a technology, an ink chamber is formed at an opposite side to a surface where the nozzles of the head chip are formed. Therefore, even if a thermal conductive plate is brought in contact with a heater provided in contact with an outer surface of the ink chamber and is brought in contact with the head chip including a nozzle board where the nozzles are formed to conduct heat of the heater to the head chip, the heat is less effectively transferred to the ink especially near the nozzles in the head chip than to the ink in the ink chamber. Therefore, there is a problem that the temperature of the ink in nozzle tip portions becomes low or the temperature of the ink in the ink chamber becomes too high and unevenness is caused in heating, and the temperature of the ink is difficult to control.

An object of the present invention is to provide an inkjet head and an inkjet recording device that can effectively heat an ink near nozzles of a nozzle board and an ink inside a head chip.

Solution to Problem

In the present invention, to achieve the above-described object, the invention described in claim 1 is an inkjet head including:

a head chip in which a nozzle board including a plurality of nozzles, each of the nozzles discharging an ink, an intermediate plate provided at an opposite side to a discharge surface to which the ink is discharged through the nozzle of the nozzle board, and allowing the nozzle and a pressure chamber that pressurizes the ink discharged through the nozzle to communicate into each other, a pressure chamber board including the pressure chamber, a spacer board provided with a piezoelectric element for pressurizing the ink in the pressure chamber, and including a passage communicating into the pressure chamber, and a wiring board provided with an ink inflow port at an opposite side to a side being in contact with the spacer board, and allowing the ink inflow port and the passage of the spacer board to communicate into each other are joined in order;

a common ink chamber forming member forming at least a part of the common ink chamber provided at a side of the wiring board of the head chip; and a heater provided to the common ink chamber forming member, wherein the nozzle board is formed smaller than the intermediate plate when the head chip is viewed from a side of the nozzle board in plan view, a thermal conductive member provided in contact with the heater, and joined with at least a part of the nozzle board and a part of the wiring board across the head chip, and the wiring board and the common ink chamber forming member are joined through the thermal conductive member to form the common ink chamber, and the thermal conductive member is joined with a side surface of the nozzle board, and at least a region of the intermediate plate at a side of the nozzle board, the region being formed larger than the nozzle board when the head chip is viewed from the side of the nozzle board in plan view.

The invention described in claim 2 is an inkjet head including:

a head chip in which a nozzle board including a plurality of nozzles, each of the nozzles discharging an ink, an intermediate plate provided at an opposite side to a discharge surface to which the ink is discharged through the nozzle of the nozzle board, and allowing the nozzle and a pressure chamber that pressurizes the ink discharged through the nozzle to communicate into each other, a pressure chamber board including the pressure chamber, a spacer board provided with a piezoelectric element for pressurizing the ink in the pressure chamber, and including a passage communicating into the pressure chamber, and a wiring board provided with an ink inflow port at an opposite side to a side being in contact with the spacer board, and allowing the ink inflow port and the passage of the spacer board to communicate into each other are joined in order;

a common ink chamber forming member forming at least a part of a common ink chamber provided at a side of the wiring board of the head chip; and a heater provided to the common ink chamber forming member, wherein the nozzle board and the intermediate plate are formed smaller than the pressure chamber board when the head chip is viewed from a side of the nozzle board in plan view, a thermal conductive member provided in contact with the heater, and joined with at least a part of the nozzle board and a part of the wiring board across the head chip, and the wiring board and the common ink chamber forming member are joined through the thermal conductive member to form the common ink chamber, and the thermal conductive member is joined with side surfaces of the nozzle board and the intermediate plate, and at least a region of the pressure chamber board at the side of the nozzle board, the region being formed larger than the nozzle board and the intermediate plate when the head chip is viewed from the side of the nozzle board in plan view.

According to the invention described in claim 3, in the inkjet head described in claim 1, the thermal conductive member includes a heat transfer plate provided in contact with the heater, a holding member being in contact with the heat transfer plate, and joined between the common ink chamber forming member and the wiring board to form the common ink chamber together with the common ink chamber forming member and the wiring board, and a top plate member joined with the holding member, and joined with at least a region of the intermediate plate at the side of the nozzle board, the region being formed larger than the nozzle board.

According to the invention described in claim 4, in the inkjet head described in claim 2, the thermal conductive member includes a heat transfer plate provided in contact with the heater, a holding member being in contact with the heat transfer plate, and joined between the common ink chamber forming member and the wiring board to form the common ink chamber together with the common ink chamber forming member and the wiring board, and a top plate member joined with the holding member, and joined with at least a region of the pressure chamber board at the side of the nozzle board, the region being formed larger than the nozzle board and the intermediate plate.

According to the invention described in claim 5, in the inkjet head described in claim 3 or 4, adjacent boards that are at least a part of the boards that configure the head chip are joined with a thermally conductive adhesive.

According to the invention described in claim 6, in the inkjet head described in any one of claims 3 to 5, the heater is provided in contact with each of the two common ink chamber forming members that form two facing side surfaces of the common ink chamber, and the heat transfer plate is arranged in contact with surfaces of the heaters at an opposite side to contact surfaces of the heaters with the common ink chamber forming members.

According to the invention described in claim 7, in the inkjet head described in any one of claims 3 to 6, an end portion of the heat transfer plate is bent and joined with the holding member.

According to the invention described in claim 8, in the inkjet head described in any one of claims 3 to 7, the holding member is provided with a groove portion fit with a bottom portion of the common ink chamber forming member.

The invention described in claim 9 is an inkjet recording device including:

the inkjet head according to any one of claims 1 to 8;

a temperature measuring unit configured to measure a temperature of an inside of the head chip or the thermal conductive member being in contact with the head chip; and a control unit configured to control an operation of the heater based on the measured temperature of the temperature measuring unit.

The invention described in claim 10 is an inkjet recording device including:

the inkjet head according to any one of claims 3 to 8;

a temperature measuring unit configured to measure a temperature of an inside of the head chip or the thermal conductive member being in contact with the head chip; and a control unit configured to control an operation of the heater based on the measured temperature of the temperature measuring unit, and the temperature measuring unit is provided in any of the holding member, the top plate member, and the spacer board.

Advantageous Effects of Invention

According to the present invention, there is an effect to effectively heat an ink near nozzles of a nozzle board and an ink inside a head chip in an inkjet head.

DESCRIPTION OF EMBODIMENTS

Hereinafter, embodiments of the present invention will be described based on the drawings.

Figure 1:
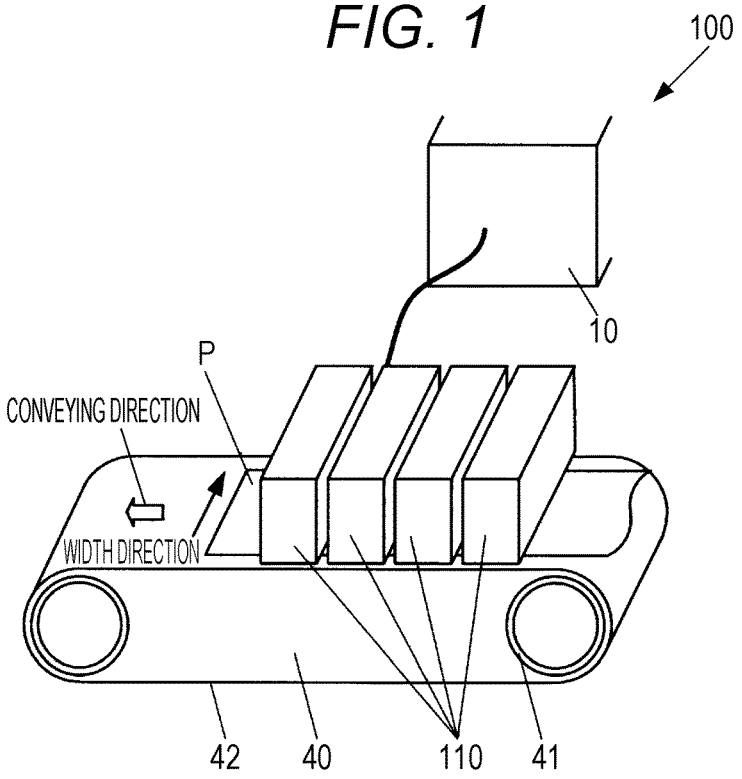
FIG. 1 is a perspective view illustrating an overall configuration of an embodiment of an inkjet recording device of the present invention.
Figure 2:
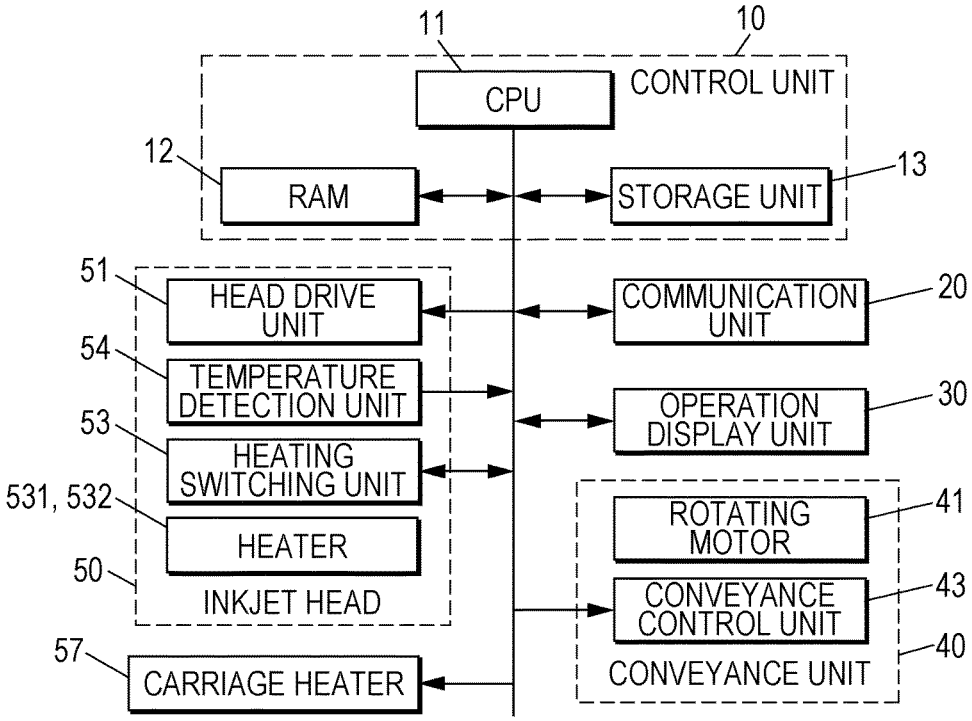
FIG. 2 is a block diagram illustrating a functional configuration of the inkjet recording device.

FIG. 1 is a perspective view illustrating an overall configuration of an embodiment of an inkjet recording device of the present invention. FIG. 2 is a block diagram illustrating a functional configuration of an inkjet recording device 100.

The inkjet recording device 100 is an one-pass inkjet recording device using a line head that discharges, in order, inks of four colors including Y (yellow), M (magenta), C (cyan), and K (black) through nozzles extending in a width direction perpendicular to a conveying direction and arrayed in a predetermined pattern (for example, houndstooth check arrangement) to a conveyed recording medium P to form an image.

The inkjet recording device 100 includes a control unit 10, a conveyance unit 40, inkjet head units 110, and the like.

The control unit 10 acquires image data for image formation, a print job, and various types of setting information regarding the image formation from an external device such as a print server or an external computer, and performs various types of processing regarding the image formation according to the print job. As illustrated in FIG. 2, the control unit 10 includes a central processing unit (CPU) 11, a random access memory (RAM) 12, a storage unit 13, and the like.

The CPU 11 performs various types of calculation processing, and integrally controls operations of the respective units of the inkjet recording device 100. Further, the CPU 11 acquires temperature data of a temperature detection unit 54, and switches ON/OFF of heaters 531 and 532 and controls the heaters.

The RAM 12 provides a memory space for work to the CPU 11, and stores temporary data. The storage unit 13 stores the image data for image formation, and temporarily stores the image data for which the various types of processing have been performed.

Further, the storage unit 13 stores various types of setting regarding the image formation. The storage unit 13 includes a volatile memory such as a dynamic RAM (DRAM), and a non-volatile memory such as a flash memory and a hard disk drive (HDD), in an appropriately combined manner.

A communication unit 20 is an interface that receives the image data for image formation, and various commands and setting regarding the print job, from an external device such as a print server or another computer, and transmits status information regarding the image formation to the external device. Examples of the communication unit 20 include a network card or a module for wireless communication. The communication unit 20 includes a tray or a slot to which a detachable portable storage medium such as a CD-ROM or a USB memory device is placed or attached, and a reading mechanism of the tray or the slot.

An operation display unit 30 includes a display screen that displays a menu and a status regarding the image formation, and an operation unit that receives an input operation of a user. The display screen is not especially limited. For example, a dot-matrix liquid crystal display is used. Various types of display are performed by a drive signal generated in a liquid crystal driver based on a control signal output from the control unit 10 (CPU 11).

As the operation unit, a touch sensor is layered on the display screen, and the display screen is used as a touch panel. As the operation unit, a button switch for power-up or a reset operation may be separately provided. Upon detection of an operation of the user, the operation unit outputs operation information to the operation display unit 30 as an electrical signal.

As illustrated in FIG. 1, a belt 42 conveyed by a rotating motor 41 is rotated and moved, so that the conveyance unit 40 moves the recording medium P placed on the belt 42 while allowing the recording medium P to face bottoms of the inkjet head units 110. A plurality of inkjet heads 50 is arrayed in a lower portion of the inkjet head unit 110, as described below, and the recording medium P is moved while facing a plurality of nozzles arrayed on bottoms of the inkjet heads 50. Alternatively, the conveyance unit 40 may have a configuration to carry and convey the recording medium P to an outer peripheral surface of a rotation drum. As illustrated in FIG. 2, the conveyance unit 40 includes a conveyance control unit 43. The conveyance control unit 43 conveys the recording medium P in synchronization with operation timing of the inkjet heads 50, transfer timing of formed image data from the storage unit 13 to the inkjet heads 50, and timing of an image formation operation in the inkjet heads 50, based on the control signal from the CPU 11. Note that the CPU 11 may integrally control the conveyance without individually providing the conveyance control unit 43.

The inkjet head units 110 are individually provided to the YMCK four colors.

Figure 3:
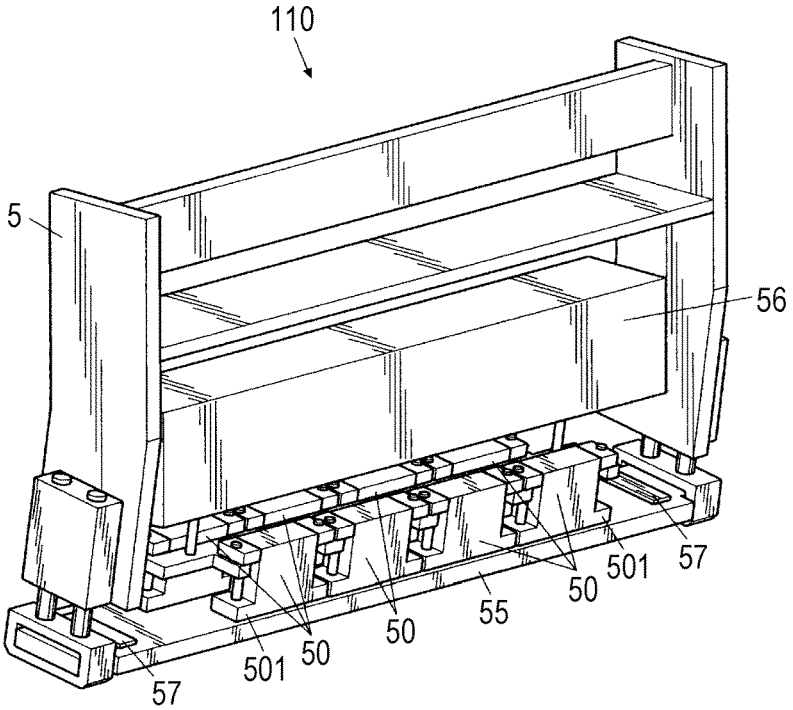
FIG. 3 is a perspective view illustrating an inkjet head unit of the inkjet recording device of the present embodiment.

FIG. 3 is a perspective view illustrating a configuration of the inkjet head unit 110.

The inkjet head unit 110 includes a carriage 5 that includes an inkjet head fixing plate 55, the plurality of inkjet heads 50, each of which discharges an ink, an ink tank 56 that stores the ink to be supplied to the inkjet heads 50, passages (not illustrated) for supplying the ink from the ink tank 56 to the inkjet heads 50, and a carriage heater 57.

The inkjet head fixing plate 55 has a length across the entire width of the recording medium P in a width direction perpendicular to the conveying direction of the recording medium P by the conveyance unit 40. The plurality of inkjet heads 50 form a plurality of lines in the width direction, and is arrayed and fixed on the inkjet head fixing plate 55, thereby to configure a line head.

The carriage heater 57 is provided on the inkjet head fixing plate 55, and heats the inkjet head fixing plate 55. In this case, the inkjet head fixing plate 55 is formed of a member having high thermal conductive properties, so that heat can be conducted to a thermal conductive member through a fixing member 501 described below. Note that the carriage heater 57 may not be provided. Further, the carriage heater 57 may be inserted in a hole portion provided in the inkjet head fixing plate 55, instead of being provided in contact with an upper surface of the inkjet head fixing plate 55.

In the inkjet head 50, a nozzle surface where a plurality of nozzles is arrayed is arranged to face a conveyance surface by the conveyance unit 40. As illustrated in FIG. 2, the inkjet head 50 includes a head drive unit 51, a temperature detection unit 54 (temperature measuring unit), a heating switching unit 53, the heaters 531 and 532, and the like. The head drive unit 51 outputs a drive voltage signal that operates the nozzles, corresponding to the image data transmitted from the storage unit 13, and discharges the ink toward the recording medium P, based on the control signal from the CPU 11 and a pulse signal that sets drive timing.

The temperature detection unit 54 measures a heating state by the heaters 531 and 532 (see FIG. 4) provided in the inkjet head 50. As the temperature detection unit 54, a thermistor thermometer is used as example. In the inkjet head 50, the temperature detection unit 54 measures the temperature in a position close to the nozzles that discharge the ink. The arrangement of the temperature detection unit 54 will be described in detail below.

The heating switching unit 53 includes a switching switch that turns ON/OFF conduction of electricity to the heaters 531 and 532. The heating switching unit 53 turns ON/OFF the conduction of electricity to the heaters 531 and 532 at appropriate timing by control of the control unit 10 (CPU 11), based on the temperature measured by the temperature detection unit 54, thereby to appropriately and collectively maintain the temperature of an ink from the common ink chamber 520 to the nozzles.

Next, a structure of the inkjet head 50 will be described.

Figure 4:
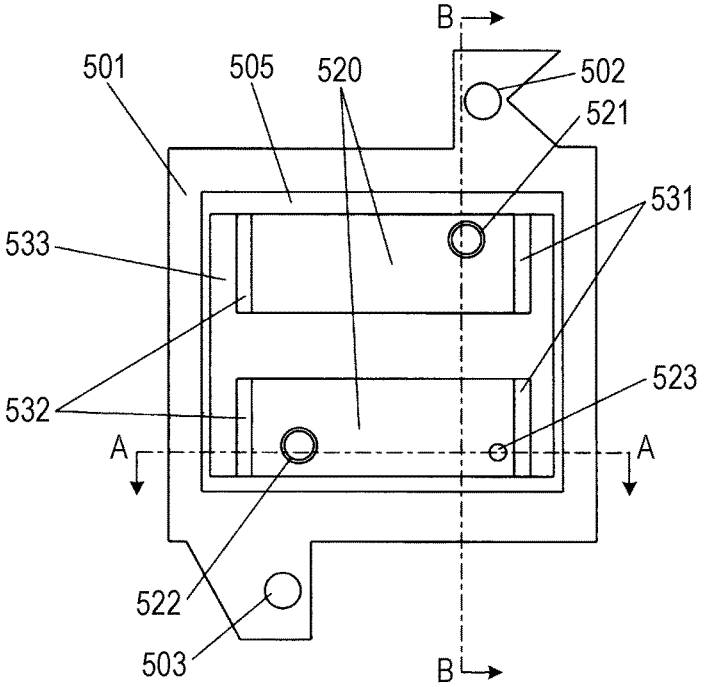
FIG. 4 is a plan view of an inkjet head as viewed from an opposite side (upper surface) to a nozzle surface.
Figure 5A:
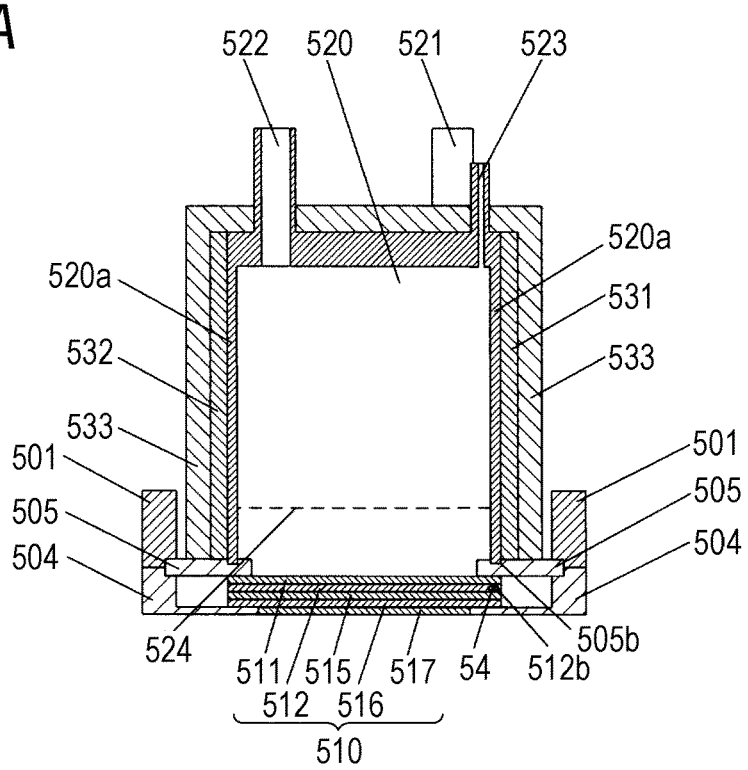
FIG. 5A is a sectional view obtained by cutting the inkjet head by a section line AA of FIG. 4.
Figure 5B:
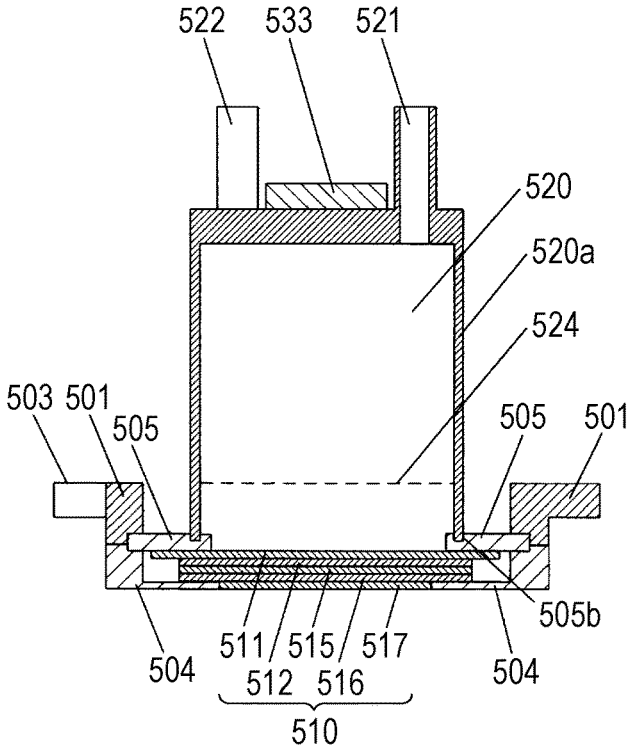
FIG. 5B is a sectional view obtained by cutting the inkjet head by a section line BB of FIG. 4.

FIG. 4 is a plan view of the inkjet head 50 as viewed from an opposite side (top surface) to the nozzle surface. FIG. 5A illustrates a sectional view obtained by cutting the inkjet head 50 by a section line AA of FIG. 4, and FIG. 5B illustrates a sectional view obtained by cutting the inkjet head 50 by a section line BB of FIG. 4.

In the inkjet head 50, a common ink chamber forming member 520*a* is layered on and joined with an upper portion of a head chip 510 including a nozzle board 517 provided with the nozzles and a wiring board 511 provided with an ink inflow port through a holding member 505 to form a space between the common ink chamber forming member 520*a* and the head chip 510, thereby to form a common ink chamber 520 (manifold). The holding member 505 is fixed to a fixing member 501 and a top plate member 504. Inlets 521 and 522 used to supply the ink and an outlet 523 used to discharge the ink are provided above the common ink chamber 520 (in a top surface of the common ink chamber forming member 520*a*). The ink supplied through the inlets 521 and 522 permeates a filter 524 and flows through the ink inflow port of the head chip 510 into an ink passage that is formed to communicate from the ink inflow port into a nozzle 517*a* in the head chip 510. The fixing member 501 includes attaching portions 502 and 503, and the fixing member 501 and the inkjet head fixing plate 55 are attached to the carriage 5 in a contact state by the attaching portions 502 and 503.

Here, the common ink chamber 520 may be configured such that two common ink chamber forming members 520*a* are arranged to face each other and joined with each other, and are joined with the head chip 510 through respective holding members 505. Further, the common ink chamber forming members 520*a* and the head chip 510 may have portions that are directly joined.

As described above, in the present invention, the common ink chamber 520 is formed such that members including the common ink chamber forming member 520*a* and the head chip 510 are joined. Hereinafter, an upper portion, side surfaces, wall surfaces, and surfaces of the common ink chamber 520 indicate respective portions of the common ink chamber forming member 520*a*.

The heaters 531 and 532 are provided in contact with an outer surface of the common ink chamber forming member 520*a*, of facing two surfaces and the surfaces different from a direction into which the wiring board 511 extends, in side surfaces of the common ink chamber 520. Further, a heat transfer plate 533 is provided to cover outsides of the heaters 531 and 532, and portions of the heat transfer plate 533, the portions covering the heaters 531 and 532, are linked across an upper portion of the common ink chamber 520.

As illustrated in FIGS. 5A and 5B, the inkjet head 50 of the present embodiment is provided with the common ink chamber 520 above the head chip 510. The heaters 531 and 532 are provided in contact with the common ink chamber forming member 520*a* that forms the facing two surfaces of the common ink chamber 520, whereby the ink inside the common ink chamber 520 can be heated in a well-balanced manner.

Further, the heat transfer plate 533 is provided in contact with outer surfaces of the heaters 531 and 532, and the heat of the heaters 531 and 532 is transferred to the heat transfer plate 533, as well as to the common ink chamber forming members 520*a*. A lower end of the heat transfer plate 533 is connected with the holding member 505. Further, as described above, the holding member 505 is fixed to the fixing member 501 and the top plate member 504. Therefore, when the holding member 505, the fixing member 501, and the top plate member 504 are formed of thermal conductive members, the heat is also transferred to the top plate member 504 and the fixing member 501 through the holding member 505.

As the heat transfer plate 533, a member having high thermal conductive properties, that is, a metal (alloy) member is favorably used. For example, an aluminum alloy is used as the heat transfer plate 533.

Figure 6A:
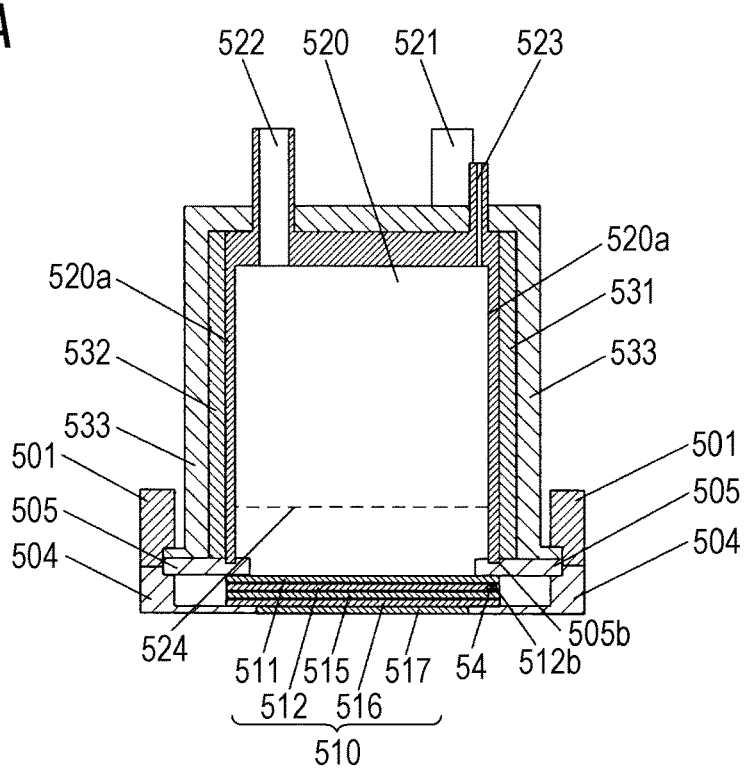
FIG. 6A is a sectional view of a modification of an inkjet head, corresponding to FIG. 5A.
Figure 6B:
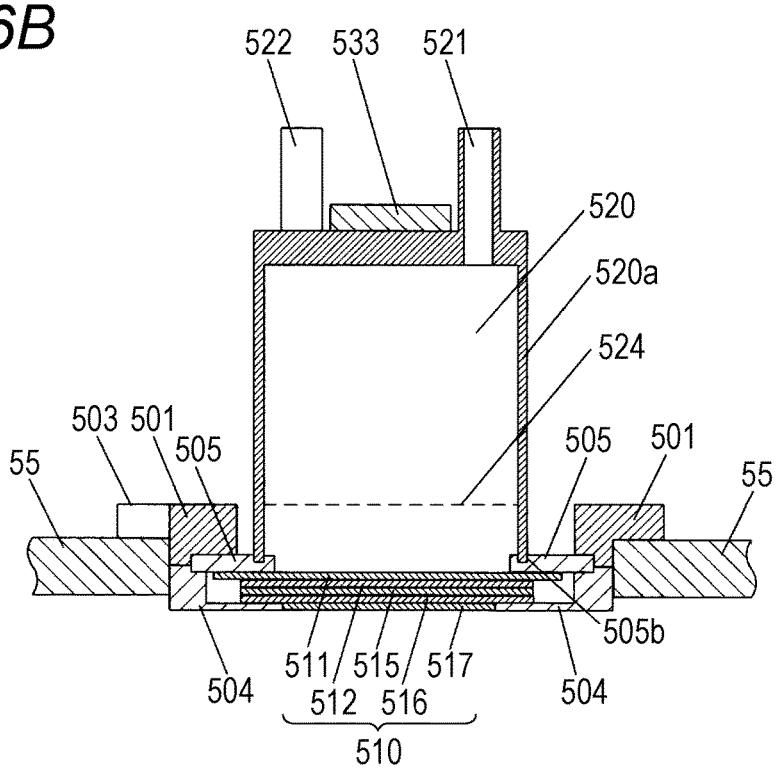
FIG. 6B is a sectional view illustrating a state in which an inkjet head is attached to an inkjet head fixing plate, corresponding to FIG. 5B.

FIG. 6A is a diagram illustrating a modification of FIG. 5A. Further, FIG. 6B is a sectional view illustrating a state in which an inkjet head 50 of FIG. 5B is fixed to an inkjet head fixing plate 55.

As illustrated in FIG. 6A, a lower end of a heat transfer plate 533 can be bent and arranged so that a contact area between the heat transfer plate 533 and a holding member 505 becomes large. In this case, the lower end of the heat transfer plate 533 is sandwiched by a top plate member 504 and a fixing member 501 with the holding member 505 and joined, so that heat is more efficiently transferred from the heat transfer plate 533 to the holding member 505, the top plate member 504, and the fixing member 501, and thus it is favorable.

As the holding member 505, a member having high thermal conductive properties, that is, a metal (alloy) member is favorably used. Since the holding member 505 is in contact with the ink flowing from the common ink chamber 520 into the ink inflow port of the wiring board 511, a stainless steel plate (for example, SUS 304) is more favorably used, from the perspective of necessity of ink-resistance. Further, as illustrated in FIGS. 5A and 5B, the holding member 505 is provided between the head chip 510 and the common ink chamber forming member 520*a* and is also joined with the heat transfer plate 533. Therefore, the ink flowing from the common ink chamber 520 into the ink inflow port of the wiring board 511 is effectively heated through the holding member 505 by the heat transferred from the heat transfer plate 533.

Further, as illustrated in FIGS. 5A and 5B, the holding member 505 is provided with a groove portion 505*b* fit with a bottom portion of the common ink chamber forming member 520*a*. With this groove portion, not only a bottom surface of the common ink chamber forming member 520*a*, but also the bottom portion of the common ink chamber forming member, that is, a part of an inner surface and a part of an outer surface of the common ink chamber forming member 520*a* are in contact with the holding member 505. Therefore, the positioned and joined common ink chamber forming member 520*a* and head chip 510 are not shifted even if external force, for example, vibration at the time of printing is applied, and thus it is favorable.

As the top plate member 504, a member having high thermal conductive properties, that is, a metal (alloy) member is favorably used. Since mist occurring when the ink is discharged through the nozzles adheres to the top plate member 504, a stainless steel plate (for example, SUS 316) is more favorably used, from the perspective of ink-resistance.

The top plate member 504 is joined with a lower surface of the holding member 505, that is, a side being in contact with the head chip 510. Further, as illustrated in FIGS. 5A and 5B, in the head chip 510, the nozzle board 517 is formed smaller than an intermediate plate 516 (at least in a portion in facing two directions across the common ink chamber 520 and in the direction into which the wiring board 511 extends), and the intermediate plate 516 sticks out from the nozzle board 517 when the head chip 510 is viewed from a joined surface side of the intermediate plate 516 with the nozzle board 517 in plan view. In this case, all or a part of the lengths of the four sides of the nozzle board 517 may be shorter than the intermediate plate 516, or a notched portion may be provided in the four sides or apart of the four sides. Further, a combination of the aforementioned configurations may be employed. The top plate member 504 is formed to have a shape fit with the sticking-out portions of the intermediate plate 516, and the top plate member 504 and the intermediate plate 516 are joined with each other.

With the top plate member 504, the mist scattering when the ink is discharged through the nozzles is prevented from adhering to the wiring board 511. Therefore, the wiring can be protected from the mist. Further, the top plate member 504 is provided to be fit with unevenness of the head chip 510. Therefore, the top plate member 504, in addition to the holding member 505, can effectively prevent shift of the positioned and joined head chip 510, and can fix the head chip 510.

As the fixing member 501, a member having high thermal conductive properties, that is, a metal (alloy) member is favorable used. For example, an aluminum alloy is used as the fixing member 501. This fixing member 501 is joined with a surface of the holding member 505 at an opposite side to the joined surface of the holding member 505 with the top plate member 504. Further, in the fixing member 501, lower surfaces of the attaching portions 502 and 503, that is, the nozzle surface side of the inkjet head 50 is positioned and fixed in contact with the top surface of the inkjet head fixing plate 55 in the carriage 5, that is, a surface of the inkjet head 50 at the side of the common ink chamber 520.

As illustrated in FIG. 3, when the carriage heater 57 is provided in the inkjet head fixing plate 55, the heat heated by the carriage heater 57 from the inkjet head fixing plate 55 is transferred to the holding member 505 and the top plate member 504 through the fixing member 501.

As described above, the heat of the heaters 531 and 532 is transferred from the heat transfer plate 533 to the holding member 505 by the heat transfer plate 533, the holding member 505, and the top plate member 504 that are formed of thermal conductive members, and the ink flowing from the common ink chamber 520 into the ink inflow port can be effectively heated. Further, the top plate member 504 and the fixing member 501 are joined with the holding member 505, and the top plate member 504 is fit with the unevenness of the head chip 510. Therefore, the heat efficiently transferred to the top plate member 504 and the fixing member 501 through the holding member 505 can be effectively transferred to the inside of the head chip 510, especially to the nozzles provided in the nozzle board 517. Accordingly, an increase in the difference between the temperature of the common ink chamber forming member 520*a* and the temperature of the head chip 510, and occurrence of a time lag in a tendency of temperature change can be suppressed.

The description has been given where the above-described embodiment uses the thermal conductive member made of the heat transfer plate 533, the top plate member 504, and the holding member 505. By configuring the thermal conductive member with the separate members as described above, assembly of the inkjet head 50 becomes easy and thus it is favorable. However, it goes without saying that an embodiment is not limited to the combination of the thermal conductive members.

In the inkjet recording device 100 of the present embodiment, a hole portion 512*b* is provided in the head chip 510, and the temperature detection unit 54 (thermistor thermometer) is inserted in the hole portion 512*b* and is in contact with an inner wall of the hole portion 512*b*, thereby to more accurately measure the temperature of the inside of the head chip 510.

Figure 7:
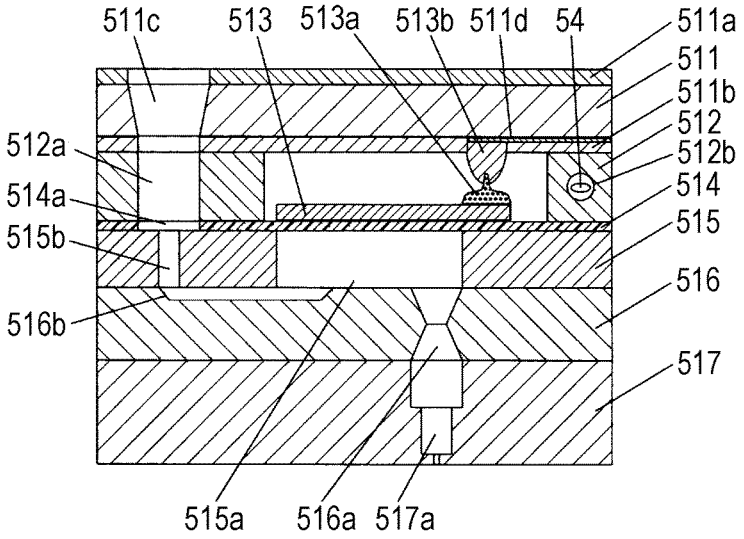
FIG. 7 is a sectional view of one nozzle of a head chip.

FIG. 7 illustrates a sectional view of one nozzle of the head chip 510.

The head chip 510 of the inkjet recording device 100 according to the present invention is formed such that the wiring board 511, a spacer board 512, a vibrating plate 514, a pressure chamber board 515, the intermediate plate 516, and the nozzle board 517 are layered in order from the top. The layered boards are joined with an appropriate adhesive member according to the material quality of the boards of both sides.

As the adhesive member for joining the boards, a thermally conductive adhesive having high thermal conductivity that can efficiently transfer the heat to the inside of the head chip 510 is used, so that the ink inside the head chip 510 can be more easily heated. As the thermally conductive adhesive, commercially available various products characterized by high thermal conductive properties can be used, and examples include the Scotch-Weld (registered trademark) thermally conductive epoxy adhesive and the NO. 9882 double-sided tape manufactured by 3M (registered trademark) Company.

The nozzle board 517 is a board made of silicon, and is positioned in an undermost layer of the head chip 510. A plurality of nozzles 517*a* is formed in the nozzle board 517. These nozzles 517*a* are arranged in a houndstooth check manner, for example, and are arrayed extending in the right and left direction (width direction) of FIG. 5A.

The intermediate plate 516 is a board made of glass, and is layered on and joined with a top surface (a surface side at an opposite side to the ink discharge surface from the nozzle 517*a*) of the nozzle board 517. A through hole 516*a* communicating into the nozzle 517*a* of the nozzle board 517 is formed in the intermediate plate 516. Further, a groove portion 516*b* forming a continuous hole is formed in a top surface of the intermediate plate 516.

The pressure chamber board 515 is a board made of silicon, and a large through hole 515*a* and a small through hole 515*b* are provided. A top surface of the large through hole 515*a* is covered with the vibrating plate 514, thereby to form the a pressure chamber for pressurizing the ink. This pressure chamber communicates into the through hole 516*a* and the groove portion 516*b* of the intermediate plate 516. Further, the small through hole 515*b* communicates into the groove portion 516*b*.

The vibrating plate 514 is layered on and joined with a top surface of the pressure chamber board 515 and covers a top surface-side opening of the through hole 515*a* that forms the pressure chamber. An oxide film is formed on a surface of the vibrating plate 514, and the vibrating plate 514 is covered and protected from the ink and the electricity. Further, a through hole 514*a* communicating into the through hole 515*b* is formed in the vibrating plate 514.

The spacer board 512 is layered on a top surface of the vibrating plate 514. This spacer board 512 is a highly thermally conductive metal (alloyed member), and is favorably formed of a member having a low coefficient of thermal expansion, for example, an alloy using Ni such as 42 alloy. The spacer board 512 has a space in which a piezoelectric element 513 is housed. The piezoelectric element 513 is made of lead zirconate titanate (PZT), and is provided in contact with the vibrating plate 514 within a range corresponding to an upper portion of the pressure chamber. The piezoelectric element 513 is connected with wiring 511*d* through a stud bump 513*a* and a solder 513*b*, and when a predetermined voltage is applied from the wiring 511*d*, the piezoelectric element 513 is deformed and vibrates the vibrating plate 514, and pressurizes the ink in the pressure chamber. Further, the spacer board 512 is provided with a through hole 512*a* communicating into the through hole 514*a*.

Further, the above-described hole portion 512*b* is provided in the spacer board 512, and the temperature detection unit 54 is inserted and arranged in the hole portion 512*b*. As described above, the hole portion 512*b* is provided in the board close to the pressure chamber board 515 (that is, the ink in the pressure chamber) in the head chip 510, and in the board made of a member (thermal conductive member) that efficiently transmits the temperature to the inside, such as metal (alloy member), whereby the temperature closer to the temperature of the ink flowing in the head chip 510 can be measured.

Note that one or a plurality of the hole portions 512*b* and the temperature detection units 54 may just be provided in the entire spacer board 512, and it is not necessary to provide the hole portions 512*b* and the temperature detection units 54 corresponding to the respective nozzles.

The wiring board 511 is provided with individual wiring connected with the solder 513*b* at a lower surface of the board made of silicon and common wiring connected to a common electrode (not illustrated), and is covered with the insulating layer 511*b*. Further, a top surface of the wiring board 511 is covered with the insulating layer 511*a*. As the insulating layers 511*a* and 511*b*, a silicon oxide film is used as example. The wiring board 511 is provided with a through hole 511*c* communicating into the through hole 512*a*, and is opened to the common ink chamber 520 in a top surface of the head chip 510 to form the ink inflow port.

Next, a temperature control operation of the heaters 531 and 532 in the inkjet recording device 100 will be described.

Figure 8:
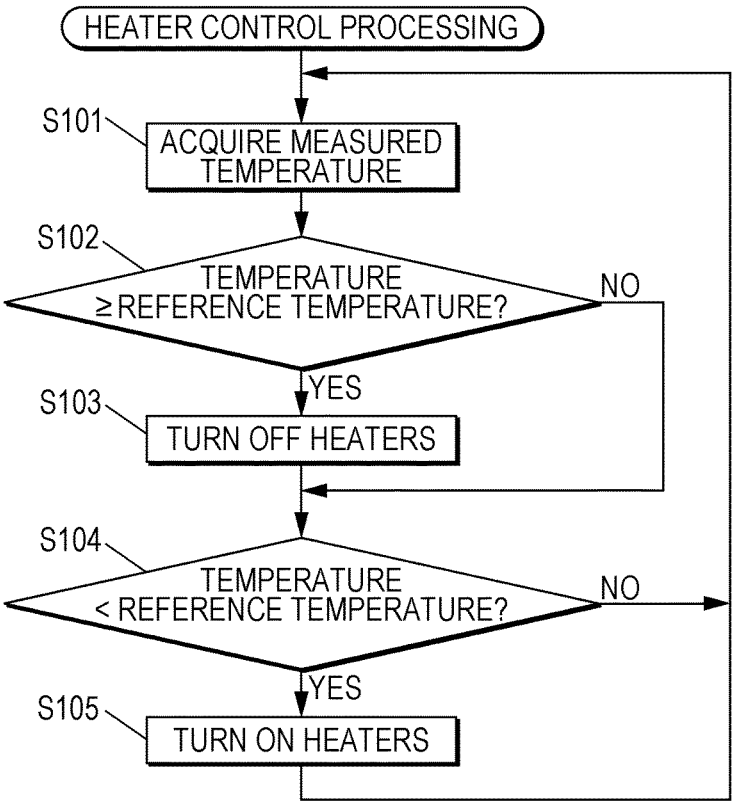
FIG. 8 is a flowchart illustrating a control procedure of heater control processing.

FIG. 8 is a flowchart illustrating a control procedure by the control unit 10 (CPU 11) of heater control processing executed in the inkjet recording device 100 of the present embodiment.

This heater control processing is started in accordance with ON of a power supply of the inkjet recording device 100, and is continuously executed during ON of the power supply.

When the heater control processing is started, the control unit 10 first acquires the measured temperature from the temperature detection unit 54 (step S101). The control unit 10 determines whether the acquired temperature is a reference temperature (here, 80° C., for example) or more (step S102). When the control unit 10 determines that the acquired temperature is the reference temperature or more ("YES" in step S102), the control unit 10 outputs the control signal to the heating switching unit 53 to turn OFF the heaters 531 and 532 (step S103), and then moves the processing to step S104.

When the control unit 10 determines that the acquired temperature is not the reference temperature or more ("NO" in step S102), the processing of the control unit 10 goes straight to step S104.

In the processing of step S104, the control unit 10 determines whether the measured temperature is less than the reference temperature (step S104). When the control unit 10 determines that the measured temperature is less than the reference temperature ("YES" in step S104), the control unit 10 sends the control signal to the heating switching unit 53 to turn ON the heaters 531 and 532 (step S105), and then the processing of the control unit 10 is returned to step S101. When the control unit 10 determines that the measured temperature is not less than the reference temperature (the measured temperature is the reference temperature or more) ("NO" in step S104), the control unit 10 returns the processing to step S101.

As described above, the head chip 510 has a layered structure, and the through holes 511*c*, 512*a*, 514*a*, 515*a*, 515*b*, and 516*a* and the groove portion 516*b* communicate into each other to form the ink passage from the ink inflow port to the nozzle 517*a*. The heat of the heaters 531 and 532 promptly and efficiently heats the head chip 510 through the holding member 505 being in contact with the heat transfer plate 533. The heat transferred to the head chip 510 is more efficiently transferred to the inside of the head chip 510, and is especially easily transferred to the pressure chamber (through hole 515*a*) and the ink inside the pressure chamber, through the thermally conductive adhesive and the spacer board 512 formed of metal material (thermally conductive material).

Further, since the temperature detection unit 54 is provided inside the spacer board 512, the temperature of the ink can be adjusted according to the temperature of the ink inside the head chip 510, compared with a conventional case. Further, as described above, the temperature of the ink inside the head chip 510 is closer to the temperature of the common ink chamber 520, and the time lag is changed in a smaller manner, than the conventional case. Therefore, the temperature of the ink inside the head chip 510 and the temperature of the ink inside the common ink chamber 520 can be easily and appropriately controlled by one time temperature measurement in a collective manner.

Note that a metal member may be used for a board other than the spacer board 512, and a hole portion may be provided in the board and the temperature detection unit 54 may be inserted in the hole portion. However, the boards need to be selected according to various factors such as the elasticity, the rigidity, and the temperature required for the boards, resistance to the ink, the cost, the weight, and the like.

[Modification]

Figure 9A:
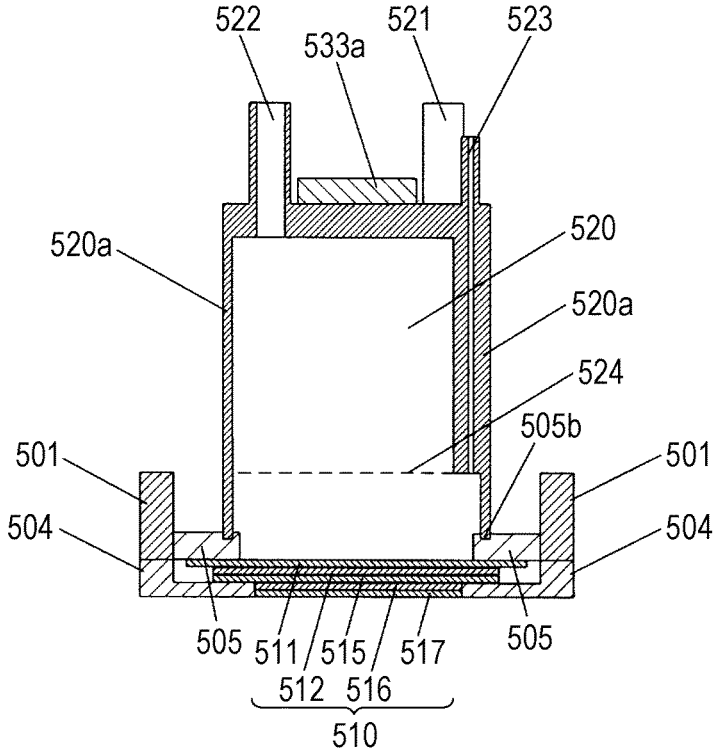
FIG. 9A is a sectional view of a modification of an inkjet head, corresponding to FIG. 5A.
Figure 9B:
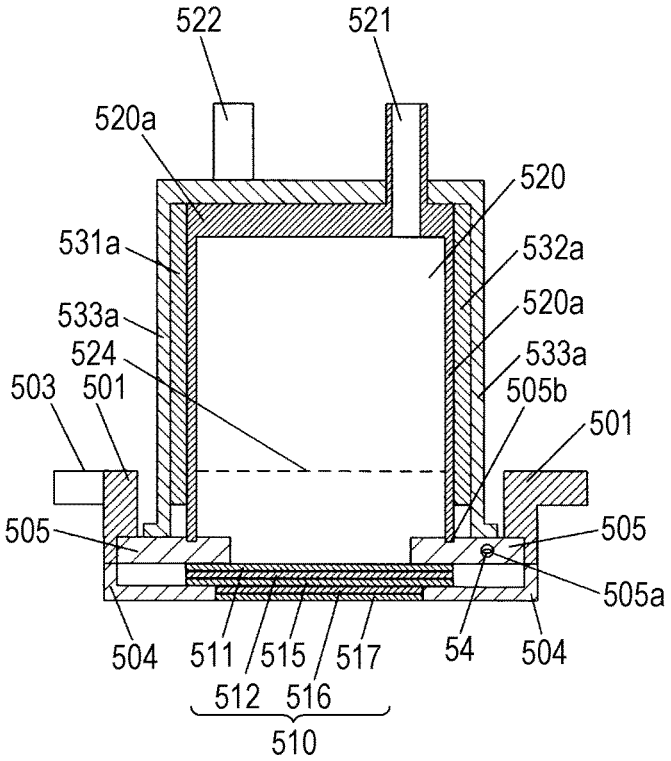
FIG. 9B is a sectional view of a modification of an inkjet head, corresponding to FIG. 5B.

FIGS. 9A and 9B illustrate sectional views of a modification of an inkjet head 50 obtained by cutting the inkjet head 50 at positions similar to the sectional views illustrated in FIGS. 5A and 5B.

In this modification, heaters 531*a* and 532*a*, and a heat transfer plate 533*a* are attached to side surfaces of a common ink chamber 520 in a 90-degree different direction to the above-described embodiment. Further, in this modification, an intermediate plate 516 is also formed smaller than a pressure chamber board 515, in addition to a nozzle board 517, in a plan view (bottom view) from a lower surface of a head chip 510. Further, in this modification, as illustrated in FIG. 9B, a hole portion 505*a* is provided in a holding member 505, in place of a hole portion 512*b*, and a temperature detection unit 54 is inserted and arranged in the hole portion 505*a*.

Here, the intermediate plate 516 is illustrated by the same size as the nozzle board 517. However, the intermediate plate 516 can have an intermediate size between the nozzle board 517 and the pressure chamber board 515.

In this case, wiring connected to the head chip 510 detours the holding member 505 and is pulled out.

Therefore, attaching positions of the heaters 531*a* and 532*a* can be appropriately set to a common ink chamber forming member 520*a*. By use of appropriate setting according to an array of ink nozzles, an ink inside the head chip 510 can be more efficiently heated, and the temperature control with less unevenness can be simply controlled.

Further, the holding member 505 faces the common ink chamber 520 and is arranged in contact with the head chip 510, and receives the heat from the heaters 531*a* and 532*a* from the heat transfer plate 533*a*. Therefore, measurement of the temperature by the temperature detection unit 54 is performed in the holding member 505, whereby the temperature of the ink in the head chip 510 and the temperature of the ink in the common ink chamber 520 can be more appropriately reflected and can be collectively controlled.

Further, the intermediate plate 516 is formed smaller than the pressure chamber board 515, in addition to the nozzle board 517, in plan view from the lower surface of the head chip 510, and thus the heat can be transferred to the inside of the head chip 510, especially to the ink in the pressure chamber board, whereby the inside of the head chip 510 can be promptly and effectively heated.

As described above, the embodiment of the inkjet head 50 according to the present invention includes the head chip 510, the common ink chamber forming member 520*a*, and the heaters 531 and 532. In the head chip 510, the nozzle board 517 including the plurality of nozzles 517*a* that discharges the ink, the intermediate plate 516 provided at the opposite side to the discharge surface to which the ink is discharged through the nozzles 517*a* of the nozzle board 517, and allows the nozzles 517*a* and the pressure chamber that pressurizes the ink to be discharged through the nozzles 517*a* to communicate into each other, the pressure chamber board 515 including the pressure chamber, the spacer board 512 including the piezoelectric element 513 for pressurizing the ink in the pressure chamber, and the wiring board 511 provided with the inflow port of the ink supplied to the plurality of nozzles at the opposite side to the side where the spacer board 512 is in contact, and allows the ink inflow port and the pressure chamber to communicate into each other are layered in order. At least a part of the common ink chamber forming member 520*a* is indirectly joined with the wiring board 511, and the common ink chamber forming member 520*a* forms the common ink chamber 520 together with the wiring board 511. The heaters 531 and 532 are provided in contact with the common ink chamber forming member 520*a*.

Then, the nozzle board 517 is formed smaller than the intermediate plate 516 when the head chip 510 is viewed from the side of the nozzle board 517 in plan view. Further, the thermal conductive members (the heat transfer plate 533, the holding member 505, and the top plate member 504) that are in contact with the heaters 531 and 532, and are joined with at least a part of the nozzle board 517 and the wiring board 511 across the head chip 510 are provided. Further, at least a part of the wiring board 511 and a part of the common ink chamber forming member 520*a* are joined with each other through the thermal conductive member (holding member 505). The thermal conductive member (holding member 505) is joined with the side surface of the nozzle board 517, and at least the region of the intermediate plate 516, a region of the region (surface) of the intermediate plate 516 at the nozzle board 517 side, the region sticking out from the nozzle board 517 because the intermediate plate 516 is formed larger than the nozzle board 517 in plan view of the head chip 510 from the nozzle board 517 side.

That is, the heat of the heaters 531 and 532 is more efficiently transferred to the thermal conductive members. Therefore, the ink near the nozzles 517*a* of the nozzle board 517 and the ink inside the head chip 510 can be effectively heated.

Further, at least one of the layered boards, here, the spacer board 512 is formed of a metal member. Therefore, the heat transferred from the heat transfer plate 533 to the head chip 510 is more efficiently transferred to the inside of the head chip 510 and can heat the ink. Especially, the spacer board 512 is in contact with the heat transfer plate 533 directly or through the holding member 505, whereby the temperature can be more promptly and reliably transferred to the inside of the head chip 510. Further, the heat is transferred to the inside of the head chip 510 in the layer close to the pressure chamber board 515. Therefore, the ink can be more easily heated inside the head chip 510.

Further, the thermal conductive member is divided into the heat transfer plate 533, the holding member 505, and the top plate member 504, and the heat of the heaters 531 and 532 is transferred to the inside of the head chip 510 together with the common ink chamber 520. Therefore, a structure regarding efficient heat transfer can be easily assembled.

Further, adjacent boards that are at least a part of the layered boards in the head chip 510 are joined with the thermally conductive adhesive, so that the heat transferred from the heat transfer plate 533 to the head chip 510 through the fixing member 501 can be easily transferred to the inside of the head chip 510. Therefore, the ink inside the head chip 510 can be the temperature closer to the ink inside the common ink chamber 520 and can have a similar tendency of temperature change.

Further, the heaters 531 and 532 are provided in contact with the common ink chamber forming members 520*a* that forms the facing two side surfaces of the common ink chamber 520, and the heat transfer plate 533 is arranged in contact with the surfaces of the heaters 531 and 532 at the opposite side to the contact surfaces of the heaters 531 and 532 with the common ink chamber forming member 520*a*. Therefore, the ink inside the common ink chamber 520 can be easily heated in a well-balanced manner. Further, the heat can be approximately uniformly transferred from the heaters 531 and 532 to the wall surfaces of the common ink chamber 520 and the heat transfer plate 533. Therefore, the temperature of the ink in the head chip 510 can be promptly closer to the temperature of the ink in the common ink chamber 520. Therefore, the temperature can be more easily and collectively controlled by the temperature measurement of the head chip 510.

Further, an end portion of the heat transfer plate 533 is bent and joined with the holding member 505. Therefore, the heat can be efficiently transferred from the heat transfer plate 533 to the top plate member 504 and the holding member 505.

Further, the groove portion 505*b* of the holding member 505 and the bottom portion of the common ink chamber forming member 520*a* are fit with each other. Therefore, when external force such as vibration at the time of printing is applied, the head chip 510 and the common ink chamber forming member 520*a* are difficult to shift from the positioned and fixed position, and can be more stably used.

Further, the inkjet head unit 110 includes the carriage 5, the carriage heater 57 provided in contact with the carriage 5, and the plurality of inkjet heads 50 arrayed and fixed to the inkjet head fixing plate 55 of the carriage 5, and the inkjet head fixing plate 55 is formed of the thermal conductive member and joined with the fixing member 501. Therefore, the heat of the carriage heater 57 can be transferred to and heat the head chip 510 through the inkjet head fixing plate 55 and the fixing member 501.

Further, the inkjet recording device 100 includes the inkjet heads 50, the temperature detection unit 54 that measures the thermal conductive members inside the head chip 510 or being in contact with the head chip 510, and the control unit 10 that operates the heating switching unit 53 based on the measured temperature, and controls ON/OFF of the conduction of the electricity to the heaters 531 and 532.

With such a configuration, the ink inside the common ink chamber 520 and the ink inside the head chip 510 can be collectively held to an appropriate temperature by simple control, based on the temperature measured in the member to which the heat is transferred in the position near the nozzles that discharge the ink. Especially, the temperature in the position close to the nozzles can be accurately held. Therefore, the image formation can be favorably performed while maintaining the quality of the ink to be discharged.

Note that the present invention is not limited to the above-described embodiments, and various changes can be made.

For example, in the above-described embodiments, the head chip 510, especially, the spacer board 512 made of a metal member is provided with the hole portion 512*b*, and the temperature is measured by the temperature detection unit 54 inserted in the hole portion 512*b*, so that the temperature based on the temperature of the ink flowing in the head chip 510 is measured. However, the temperature of the head chip 510 can be acquired such that the temperature detection unit 54 is embedded in a groove portion provided in a surface in place of the hole portion, or the temperature detection unit 54 is simply provided in contact with a side surface of the spacer board 512.

As the portion where the temperature detection unit 54 is in contact, the holding member 505 being in contact with the head chip 510 has been exemplarily described, other than the spacer board 512. However, another portion, for example, the top plate member 504 may be used, as long as the another portion is made of the thermal conductive member through which the heat is promptly transferred from the heat transfer plate 533, inside the head chip 510 or a position being in contact with the head chip 510. In these configurations, the temperature can be collectively controlled based on measured data of the temperature closer to the temperature of the ink in the head chip 510, and more promptly in conjunction with change of the temperature of the common ink chamber 520.

Further, in the above-described embodiments, the spacer board 512 is formed of a metal member. However, the spacer board 512 may not be formed of a metal member. In this case, when the thermal conductivity of the spacer board 512 is not higher than the metal member, for example, the heat may be transferred from the holding member 505 to the head chip 510 through the thermally conductive adhesive, or electric wiring may be heated when there is no problem about the combination of a set temperature and an electric wiring member. Alternatively, wiring by thermal conductive member for heat transfer may be separately provided to the head chip 510. The strength, corrosion-resistance to the ink, and the like are not required for the thermal conductive member regarding the thermal conductive wiring according to the position of the wiring. Therefore, in this case, the thermal conductive member is not limited to the metal member, and various known thermally conductive resins may be used.

Further, in the above-described embodiments, as the reference temperature regarding the ON/OFF control of the heaters 531 and 532, a uniform temperature, for example, 80° C. is set. However, the reference temperature of when the heaters are turned OFF and the reference temperature of when the heaters are turned ON may be differentiated. For example, the heaters may be turned OFF at 80° C. and turned ON at 75° C.

Further, in the above-described embodiments, as the temperature detection unit 54, the thermistor thermometer is used. However, the temperature may be measured using a small temperature sensor such as another IC chip.

Further, in the above-described embodiments, the heating control is performed by the control unit 10 (CPU 11). However, a control unit for heater control may be individually provided inside the inkjet head 50.

Further, in the above-described embodiments, the description has been given exemplarily using the head chip 510 having a layered structure in which the planar nozzle board 517 and wiring board 511, and the boards provided therebetween are simply layered. However, the boards are not limited to the simple flat plate. A board having an uneven structure in an up and down direction may be used, or a plurality of local boards may be arrayed in a horizontal direction (front-to-back and side-to-side directions) as long as the head chip 510 has a structure in which the common ink chamber 520 is layered arranged on the top surface of the head chip 510 at the opposite side to the lower surface where the nozzles are provided, and the ink is supplied to openings of the nozzles from the common ink chamber 520 through the respective ink passages.

Further, in the above-described embodiments, the heaters are provided in contact with the common ink chamber forming members 520*a* that form the facing two surfaces of the common ink chamber 520. However, the heaters may be provided on the common ink chamber forming members 520*a* of all four surfaces, or at four corners. Further, the heaters may be provided on the common ink chamber forming members 520*a* that form three surfaces of the common ink chamber 520, or may be provided on the upper portion of the common ink chamber 520, as long as the ink can be heated in a well-balanced manner.

Further, the heaters 531 and 532 are not limited to the plate-like members being in contact with the common ink chamber forming member 520*a*, and a plurality of rod-like heaters may be arranged in contact with the common ink chamber forming member 520*a*.

Further, in the above-described embodiments, the heaters 531 and 532 are provided in contact with the common ink chamber forming member 520*a*, and the heat transfer plate 533 is further provided outside thereof. However, heat control with less unevenness can be performed for the common ink chamber 520 and the head chip 510 even in a reverse order, that is, even a structure in which the heat transfer plate 533 is provided in contact with the common ink chamber forming member 520*a*, and the heaters 531 and 532 are provided outside the heat transfer plate 533.

Further, the nozzle board 517 and the top plate member 504 may not be individually provided, and a nozzle plate including a metal member or formed of a metal member may be provided and directly heated from the heat transfer plate 533 or through the fixing member 501. In this case, especially, the nozzle plate needs to be formed such that the shapes and the positions of the nozzles are not changed in heating.

Further, in the above-described embodiments, the lower end portion of the heat transfer plate 533 is bent and fit with the fixing member 501 and the top plate member 504, and the contact area is increased. However, an embodiment is not limited thereto. For example, a lower end shape of the heat transfer plate 533 may be formed thick, or the shape of the fixing member 501 may be changed and the heat transfer plate 533 may be sandwiched from both sides.

Further, in the above-described embodiments, the description has been given exemplarily using the line head inkjet recording device. However, a serial head inkjet recording device may be used.

In addition, the specific details described in the above embodiments, such as the structure of the head chip 510, and the arrangement and the positional relationship among the heaters 531 and 532, the heat transfer plate 533, the fixing member 501, and the top plate member 504, can be appropriately changed without departing from the gist of the present invention.

INDUSTRIAL APPLICABILITY

The present invention can be used for an inkjet head and an inkjet recording device.

REFERENCE SIGNS LIST

5 Carriage
10 Control unit
11 CPU
12 RAM
13 Storage unit
20 Communication unit
30 Operation display unit
40 Conveyance unit
41 Rotating motor
42 Belt
43 Conveyance control unit
50 Inkjet head
501 Fixing member
502 and 503 Attaching portion
504 Top plate member
505 Holding member
505*a* Hole portion
505*b* Groove portion
51 Head drive unit
510 Head chip
511 Wiring board
511*a* Insulating layer
511*b* Insulating layer
511*c* Through hole
511*d* Wiring
512 Spacer board
512*a* Through hole
512*b* Hole portion
513 Piezoelectric element
513*a* Stud bump
513*b* Solder
514 Vibrating plate
514*a* Through hole
515 Pressure chamber board
515*a* Through hole
515*b* Through hole
516 Intermediate plate
516*a* Through hole
516*b* Groove portion
517 Nozzle board
517*a* Nozzle
520 Common ink chamber
520*a* Common ink chamber forming member
521 and 522 Inlet
523 Outlet
524 Filter
53 Heating switching unit
531 and 532 Heater
531*a* and 532*b* Heater
533 and 533*a* Heat transfer plate
54 Temperature detection unit
55 Inkjet head fixing plate
56 Ink tank
57 Carriage heater
100 Inkjet recording device
110 Inkjet head unit
P Recording medium

The invention claimed is:

1. An inkjet head comprising:
a head chip in which
a nozzle board including a plurality of nozzles, each of the nozzles discharging an ink,
an intermediate plate provided at an opposite side to a discharge surface to which the ink is discharged through the nozzle of the nozzle board, and allowing the nozzle and a pressure chamber that pressurizes the ink discharged through the nozzle to communicate into each other,
a pressure chamber board including the pressure chamber,
a spacer board provided with a piezoelectric element for pressurizing the ink in the pressure chamber, and including a passage communicating into the pressure chamber, and
a wiring board provided with an ink inflow port at an opposite side to a side being in contact with the spacer board, and allowing the ink inflow port and the passage of the spacer board to communicate into each other are joined in order;
a common ink chamber forming member forming at least a part of the common ink chamber provided at a side of the wiring board of the head chip; and
a heater provided to the common ink chamber forming member, wherein
the nozzle board is formed smaller than the intermediate plate when the head chip is viewed from a side of the nozzle board in plan view,
a thermal conductive member provided in contact with the heater, and joined with at least a part of the nozzle board and a part of the wiring board across the head chip, and
the wiring board and the common ink chamber forming member are joined through the thermal conductive member to form the common ink chamber, and the thermal conductive member is joined with a side surface of the nozzle board, and at least a region of the intermediate plate at a side of the nozzle board, the region being formed larger than the nozzle board when the head chip is viewed from the side of the nozzle board in plan view.

2. The inkjet head according to claim 1, wherein
the thermal conductive member includes
a heat transfer plate provided in contact with the heater,
a holding member being in contact with the heat transfer plate, and joined between the common ink chamber forming member and the wiring board to form the common ink chamber together with the common ink chamber forming member and the wiring board, and
a top plate member joined with the holding member, and joined with at least a region of the intermediate plate at the side of the nozzle board, the region being formed larger than the nozzle board.

3. The inkjet head according to claim 2, wherein adjacent boards that are at least a part of the boards that configure the head chip are joined with a thermally conductive adhesive.

4. The inkjet head according to claim 2, wherein the heater is provided in contact with each of the two common ink chamber forming members that form two facing side surfaces of the common ink chamber, and the heat transfer plate is arranged in contact with surfaces of the heaters at an opposite side to contact surfaces of the heaters with the common ink chamber forming members.

5. The inkjet head according to claim 2, wherein an end portion of the heat transfer plate is bent and joined with the holding member.

6. The inkjet head according to claim 2, wherein the holding member is provided with a groove portion fit with a bottom portion of the common ink chamber forming member.

7. An inkjet recording device comprising:

the inkjet head according to claim 2;

a temperature measuring unit configured to measure a temperature of an inside of the head chip or the thermal conductive member being in contact with the head chip; and a control unit configured to control an operation of the heater based on the measured temperature of the temperature measuring unit, wherein the temperature measuring unit is provided in any of the holding member, the top plate member, and the spacer board.

8. An inkjet recording device comprising:

the inkjet head according to claim 1;

a temperature measuring unit configured to measure a temperature of an inside of the head chip or the thermal conductive member being in contact with the head chip; and a control unit configured to control an operation of the heater based on the measured temperature of the temperature measuring unit.

9. An inkjet head comprising:

a head chip in which a nozzle board including a plurality of nozzles, each of the nozzles discharging an ink, an intermediate plate provided at an opposite side to a discharge surface to which the ink is discharged through the nozzle of the nozzle board, and allowing the nozzle and a pressure chamber that pressurizes the ink discharged through the nozzle to communicate into each other, a pressure chamber board including the pressure chamber, a spacer board provided with a piezoelectric element for pressurizing the ink in the pressure chamber, and including a passage communicating into the pressure chamber, and a wiring board provided with an ink inflow port at an opposite side to a side being in contact with the spacer board, and allowing the ink inflow port and the passage of the spacer board to communicate into each other are joined in order;

a common ink chamber forming member forming at least a part of a common ink chamber provided at a side of the wiring board of the head chip; and a heater provided to the common ink chamber forming member, wherein the nozzle board and the intermediate plate are formed smaller than the pressure chamber board when the head chip is viewed from a side of the nozzle board in plan view, a thermal conductive member provided in contact with the heater, and joined with at least a part of the nozzle board and a part of the wiring board across the head chip, and the wiring board and the common ink chamber forming member are joined through the thermal conductive member to form the common ink chamber, and the thermal conductive member is joined with side surfaces of the nozzle board and the intermediate plate, and at least a region of the pressure chamber board at the side of the nozzle board, the region being formed larger than the nozzle board and the intermediate plate when the head chip is viewed from the side of the nozzle board in plan view.

10. The inkjet head according to claim 9, wherein the thermal conductive member includes a heat transfer plate provided in contact with the heater, a holding member being in contact with the heat transfer plate, and joined between the common ink chamber forming member and the wiring board to form the common ink chamber together with the common ink chamber forming member and the wiring board, and a top plate member joined with the holding member, and joined with at least a region of the pressure chamber board at the side of the nozzle board, the region being formed larger than the nozzle board and the intermediate plate.

11. The inkjet head according to claim 10, wherein adjacent boards that are at least a part of the boards that configure the head chip are joined with a thermally conductive adhesive.

12. The inkjet head according to claim 10, wherein the heater is provided in contact with each of the two common ink chamber forming members that form two facing side surfaces of the common ink chamber, and the heat transfer plate is arranged in contact with surfaces of the heaters at an opposite side to contact surfaces of the heaters with the common ink chamber forming members.

13. The inkjet head according to claim 10, wherein an end portion of the heat transfer plate is bent and joined with the holding member.

14. The inkjet head according to claim 10, wherein the holding member is provided with a groove portion fit with a bottom portion of the common ink chamber forming member.

15. An inkjet recording device comprising:

the inkjet head according to claim 10;

a temperature measuring unit configured to measure a temperature of an inside of the head chip or the thermal conductive member being in contact with the head chip; and a control unit configured to control an operation of the heater based on the measured temperature of the temperature measuring unit, wherein the temperature measuring unit is provided in any of the holding member, the top plate member, and the spacer board.

16. An inkjet recording device comprising:

the inkjet head according to claim 9;

a temperature measuring unit configured to measure a temperature of an inside of the head chip or the thermal conductive member being in contact with the head chip; and a control unit configured to control an operation of the heater based on the measured temperature of the temperature measuring unit.

* * * * *